US006655162B2

(12) United States Patent
McKee

(10) Patent No.: US 6,655,162 B2
(45) Date of Patent: Dec. 2, 2003

(54) AUXILIARY WATERING SYSTEM FOR COOLING THE AMBIENT AIR SUPPLY OF AN AIR-CONDITIONING UNIT

(76) Inventor: Michael C. McKee, P.O. Box 87, Arlington Heights, IL (US) 60006

( * ) Notice: Subject to any disclaimer, the term of this patent is extended or adjusted under 35 U.S.C. 154(b) by 0 days.

(21) Appl. No.: 10/034,765

(22) Filed: Dec. 27, 2001

(65) Prior Publication Data

US 2003/0121273 A1 Jul. 3, 2003

(51) Int. Cl.[7] ..... F28D 3/00; F28D 5/00

(52) U.S. Cl. ..... 62/171; 62/305

(58) Field of Search ..... 62/171, 304, 305, 62/271, 428; 261/131, 140.1

(56) References Cited

U.S. PATENT DOCUMENTS

| | | | | |
|---|---|---|---|---|
| 3,613,392 A | | 10/1971 | DiTucci | |
| 4,240,265 A | | 12/1980 | Faxon | |
| 4,530,218 A | | 7/1985 | Janke et al. | |
| 4,542,627 A | * | 9/1985 | Welker | 62/171 |
| 5,117,644 A | * | 6/1992 | Fought | 62/171 |
| 5,311,747 A | * | 5/1994 | Pringle et al. | 62/183 |
| 5,774,423 A | | 6/1998 | Pearce et al. | |
| 6,105,376 A | * | 8/2000 | Stewart et al. | 62/171 |
| 6,253,565 B1 | | 7/2001 | Arledge | |

* cited by examiner

*Primary Examiner*—Marc Norman
(74) *Attorney, Agent, or Firm*—Michael R. McKenna

(57) ABSTRACT

An auxiliary watering system and methods for lowering the temperature of an ambient air supply to an air-conditioning unit that is controlled solely by an acoustic signal from the air-conditioning unit.

19 Claims, 4 Drawing Sheets

AUXILIARY WATERING SYSTEM FOR COOLING THE AMBIENT AIR SUPPLY OF AN AIR-CONDITIONING UNIT

BACKGROUND OF THE INVENTION

The invention relates to an auxiliary watering system for cooling the ambient air supply to an existing outdoor air-conditioning unit. It is well known that applying a light water mist or spray to an inlet air supply to an air conditioner heat exchanger coil can reduce the energy required to provide cooling. The instant invention provides a water supply controlling mechanism for misting/spraying device (s) used for water cooling of an air conditioner condenser unit.

The environment in which the auxiliary watering system of the present invention is used includes an air-conditioning unit provided with a condenser, condenser coils, a fan for moving air over said condenser coils, and an ambient air supply for cooling the air-conditioning unit. The auxiliary watering system comprises means for delivering cooling water along an air path to lower the temperature of the ambient air supply responsive to control signals which are independent of a hardwiring control connection to the air-conditioning unit.

A number of patents have been issued concerning the efficiency gains to be had by using water misting/cooling at the condenser unit of a typical residential air conditioner. See for example, U.S. Pat. No. 6,253,565 issued to Arledge in July, 2001 for a H2O mist kit and method for home external condenser units. Also see U.S. Pat. No. 3,613,292 issued in 1969 to Di Tucci which discloses an air conditioner having a spraying apparatus for spraying water on condenser coils of the air conditioner unit, said spray being triggered by a solenoid valve connected to a thermostat.

U.S. Pat. No. 4,240,265 issued in 1980 to Faxon provides for a mist spray apparatus for air conditioner condenser for applying a mist of water or other liquid to the coils and fins of the condenser to improve the heat transfer capability of the condenser.

Furthermore see U.S. Pat. No. 4,530,218 issued to Janke et al. in 1985 for a refrigeration apparatus defrost control for use in a refrigeration apparatus which includes a control circuit utilizing different types of frost sensors, including pressure sensors, acoustical sensors.

Additionally, see U.S. Pat. No. 5,774,423 issued to Pearce et al. in 1998 for an acoustic sensor that is electrically coupled to provide a response corresponding to a hydrodynamic pressure.

ADVANTAGES OF THIS INVENTION

Unlike the foregoing devices which teach structures that hard wired control connections, control signals for the instant device are independent of a hardwiring control connection to the air-conditioning unit.

The foregoing devices are ineffective however in their implementation of the mechanism to control the water supply. All of the units require that the control solenoid or valve be coupled to the thermostat or other electrical interface. It is not a trivial endeavor to make this type of electrical connection for the average person. To alleviate this problem, and others which will become apparent from the disclosure which follows, the present invention conveniently eliminates the control connection requirement in exchange for a stand-alone, battery-operated device to control the supply valve. The device of the current invention requires only the attachment of a garden-type hose and its placement in the acoustic or seismic proximity of the condenser/fan unit.

Another advantage is that the operation of either the condenser or the fan can be sensed by the means for delivering cooling water to control cooling water being delivered to the ambient air supply. Because the sensor for ascertaining whether the air-conditioning unit is non-fixtured, the portability and removablity of this auxiliary watering system for cooling the ambient air supply is obvious.

The instant device is implemented with a common garden hose being extended from a spigot to within close proximity of the condenser/fan unit and attached to this auxiliary watering system. The outlet from the supply valve regulated by the controller attaches to the misting/spraying unit(s). The sensor is placed in the proximity (approximately 6–18 inches) of the air conditioner's condenser and/or fan, and when the condenser and/or fan, is running a switch is activated on the controller to enable the unit to begin a data collection and tuning process. After a short time, the unit is returned to its normal state and it begins to monitor the environment. When the sensor unit senses that the fan is running, the water supply is activated and cools the air to the condenser coils accordingly.

The methods based on an acoustic or seismic "listening device" located in the proximity of the condenser/fan unit of a residential type air conditioner provides a simple, safe, stand-alone mechanism to control water flow to an external misting or spraying attachment at or near the unit. An auxiliary objective of the device "recognizes" the frequency characteristics of the operating fan and activate a solenoid to provide water to the condensation coils when the fan is running and to deactivate the water when not running, thus preventing water waste.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

Still other advantages will be apparent from the disclosure that follows.

SUMMARY OF THE INVENTION

An auxiliary watering system for cooling the ambient air supply in an environment which includes an air-conditioning unit provided with a condenser, condenser coils, a fan for moving air over said condenser coils, and an ambient air supply for cooling the air-conditioning unit, the auxiliary watering system for cooling the ambient air supply comprises means for delivering cooling water along an air path to lower the temperature of the ambient air supply responsive to control signals which are independent of a hardwiring control connection to the air-conditioning unit. In this way, operation of either the condenser or the fan can be sensed by the means for delivering cooling water to control cooling water being delivered to the ambient air supply.

The portability of this auxiliary watering system for cooling the ambient air supply comprises a cooling water supply valve operably connected to a non-fixtured sensor for ascertaining whether the air-conditioning unit is operating, and a valve controller responsive to the sensor. Because the sensor detects the operation of the air-conditioning unit acousticly, its does not require control wiring connected directly to the air-conditioning unit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
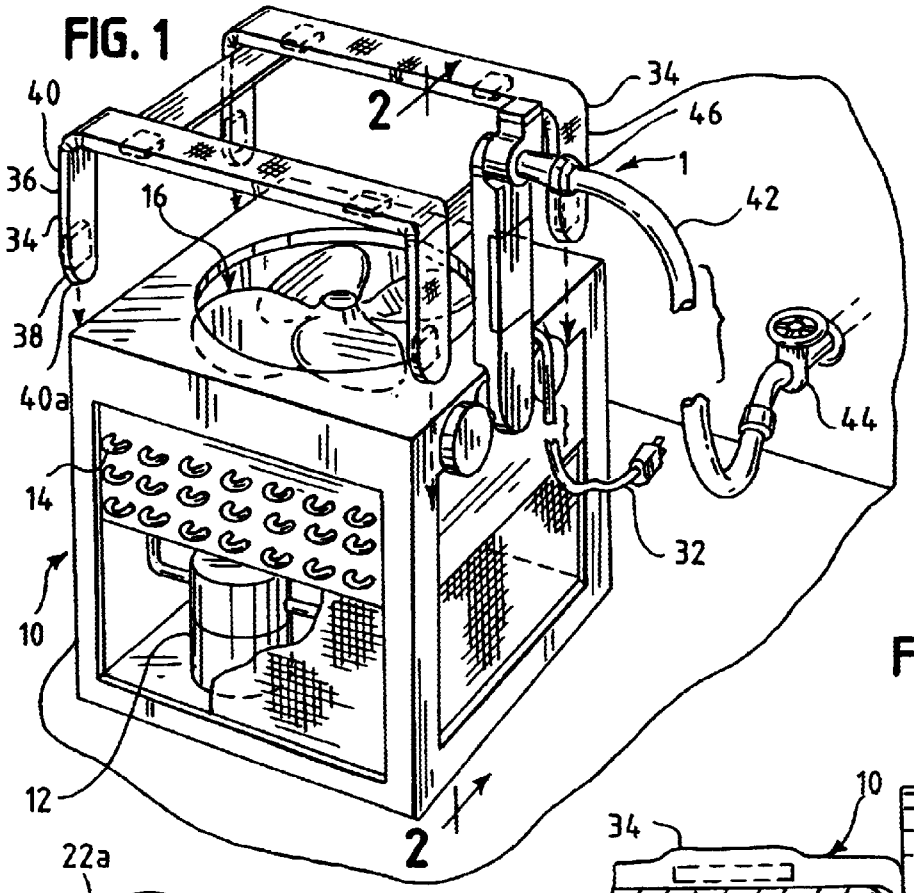
FIG. 1 is an exploded perspective view of an auxiliary watering system for improving the ambient air supply of the instant invention exploded away from an air conditioning unit.

The preferred embodiments depicted in the drawing comprise an auxiliary watering system for cooling the ambient air supply to an air-conditioning unit comprising means for delivering cooling water along an air path to lower the temperature of the ambient air supply that responds to control signals which are independent of a hardwiring control connection to the air-conditioning unit. Preferably, the control signals are independent of an electrical connection from one of the condenser and the fan of the air-conditioning unit.

The invention relates to methods and an auxiliary watering system for cooling the ambient air supply to an air-conditioning unit, whereby, operation of one of the condenser and the fan is sensed by the means for delivering cooling water to control cooling water being delivered to the ambient air supply.

The methods and means for delivering cooling water of the auxiliary watering system may further comprise a pattern recognition means and a discrimination means. The pattern recognition means recognizes an acoustic pattern of at least one of the condenser and the fan of the air-conditioning unit, and produces code signals with respect to each acoustic pattern from the result of the recognition. The code signals define traits of the recognized acoustic pattern, and the acoustic patterns define attributes of the air-conditioning unit.

Without departing from the generality of the invention disclosed herein and without limiting the scope of the invention, the discussion that follows, will refer to the invention as depicted in the drawing.

The preferred embodiments of the apparatus depicted in the drawing comprise, in an environment which includes an air-conditioning unit 10 provided with a condenser 12, condenser coils 14, a fan 16 for moving air over the condenser coils 14, and an ambient air supply for cooling the air-conditioning unit, an auxiliary watering system for cooling the ambient air supply comprising means for delivering cooling water 1 along an air path (designated by arrows in FIG. 3) to lower the temperature of the ambient air supply that responds to control signals 2 which are independent of a hardwiring control connection to the air-conditioning unit 10. Whereby, operation of one of the condenser 12 and the fan 16 is sensed by the means for delivering cooling water 1 to control cooling water being delivered to the ambient air supply.

Preferably, the control signals 2 are independent of an electrical connection from one of the condenser 12 and the fan 16 of the air-conditioning unit 10.

Additionally, the means for delivering cooling water of the auxiliary watering system may further comprise a pattern recognition means 3 and a discrimination means 4. The pattern recognition means recognizes an acoustic pattern 5 of at least one of the condenser 12 and the fan 16 of the air-conditioning unit 10, and produces code signals 2 with respect to each acoustic pattern 5 from the result of the recognition. The code signals 2 define traits of the recognized acoustic pattern 5, and the acoustic patterns 5 define attributes of the air-conditioning unit 10.

The discrimination means 4 has a pattern memory 7 in which an initial set of code signals associated with an initial set of recognized acoustic patterns is stored. The initial set of code signals (identifying code signals) 7*a* define initial attributes of the at least one of the condenser 12 and the fan 16 of the air-conditioning unit 10. The discrimination means 4 further compares the pattern recognition code signals 8 with the initial set of code signals 7*a* stored in the pattern memory 7, and produces an identifying signal 7*b*. The identifying signal defines a corresponding acoustic pattern with code signals that match the initial code signals from the result of the recognition of the initial acoustic pattern of the at least one of the condenser and the fan of the air-conditioning unit. Matches of the corresponding acoustic pattern with the initial acoustic pattern identifies that the air-conditioning unit is operating.

Signal processing software or hardware within the unit analyses the frequency characteristics of the running fan 16 and stores this into a non-volatile memory 7 during the initial "teach-in" period. This allows the unit to be self-tuning, thus providing a degree of freedom from false triggers. It will not generally be activated by extraneous household noises. After the unit has been "taught" the normal signature of the fan unit, it will periodically monitor the status of the acoustic/seismic environment, process the information, and activate a signal accordingly. Depending on the configuration of the hardware and software, the discrimination means 4 may be made integral with the pattern recognition means 3.

Furthermore, the auxiliary watering system may include means for filtering 9 the acoustic pattern 5 of one of the condenser and the fan in connection with the pattern recognition means.

Figure 2:
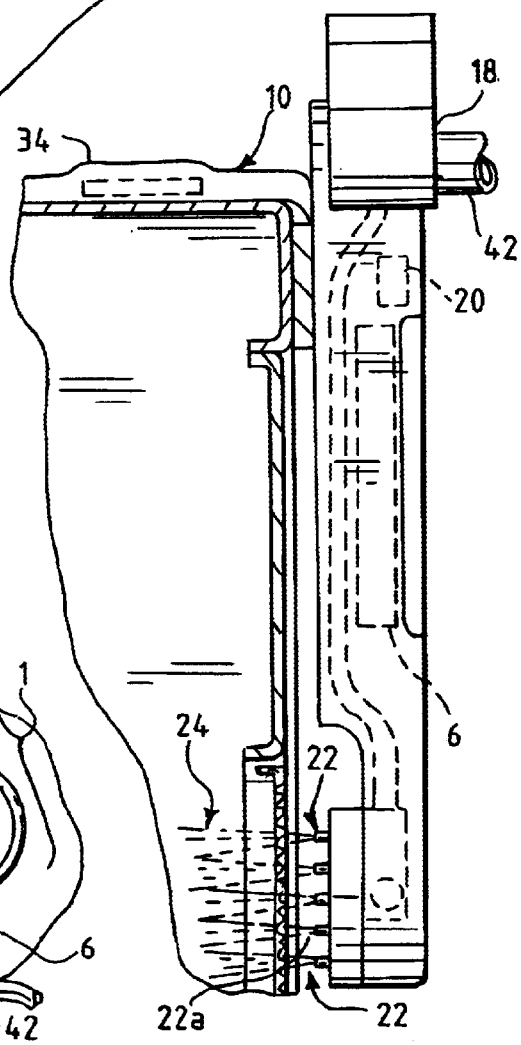
FIG. 2 is a side elevation view taken along the line of 2—2 of FIG. 1 showing means for delivering cooling water containing the sensor, valve controller and supply valve for the means for delivering water.

As shown in FIG. 2, the means for delivering cooling water 1 of auxiliary watering system may comprise a cooling water supply valve 18 operable between an opened position and a closed position, a sensor 6 for ascertaining whether the air-conditioning unit is operating and for generating control signals 8, and a valve controller 20 that receives the control signals 2. The valve controller 20 is operably connected to the cooling water supply valve 18.

Figure 7:
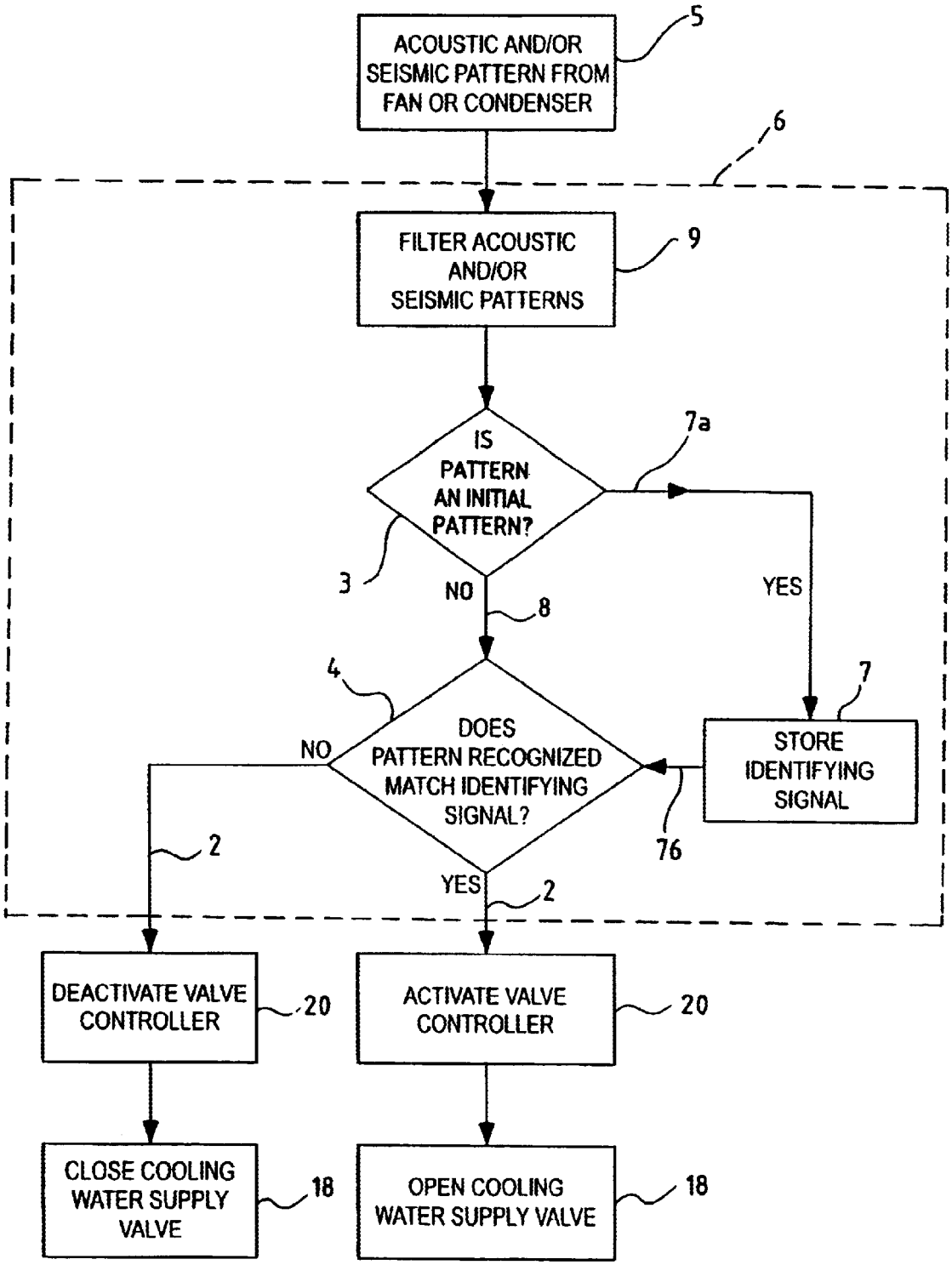
FIG. 7 is a flow diagram of a preferred embodiment of the operation of the auxiliary watering system of the present invention.

As shown in FIG. 7, the cooling water supply valve 18 is opened by the valve controller 20 upon receiving a control signal 2 from the sensor 6 indicating that the air-conditioning unit 10 is operating and the cooling water supply valve 18 is closed by the valve controller 20 upon receiving a control signal 2 from the sensor 6 that the air-conditioning unit 10 is non-operational.

Figure 3:
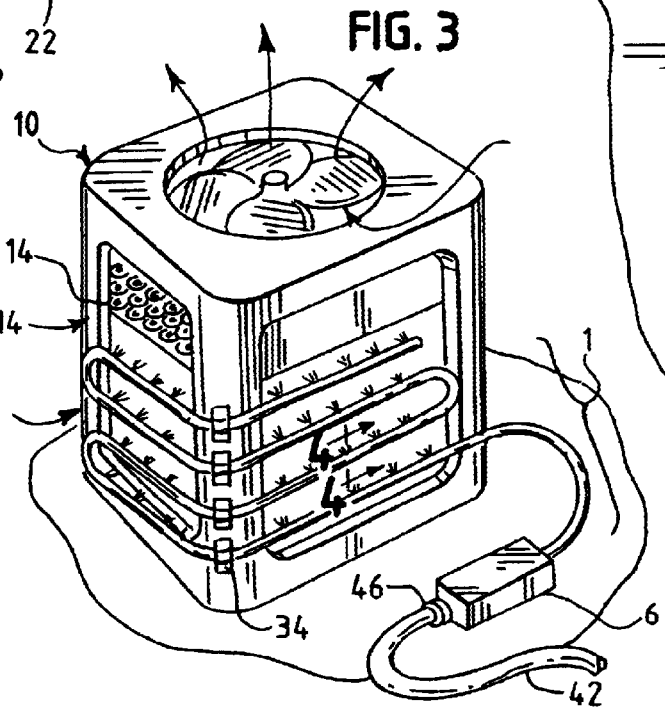
FIG. 3 is a perspective view of another embodiment of the auxiliary watering system showing water distribution headers with nozzles disposed proximate to the air conditioning inlet for the air supply.

Preferably, the sensor 6 of the auxiliary watering system detects an acoustic pattern 5 associated with the operation of the air-conditioning unit 10. The term acoustic pattern 5 as used herein includes a seismic pattern 5*a*. In one preferred embodiment, as best seen in FIG. 3, the sensor is disposed at a spaced distance from the air-conditioning unit 10. As shown in FIG. 3, the sensor 6 may be detached from the air-conditioning unit 10.

Figure 6:
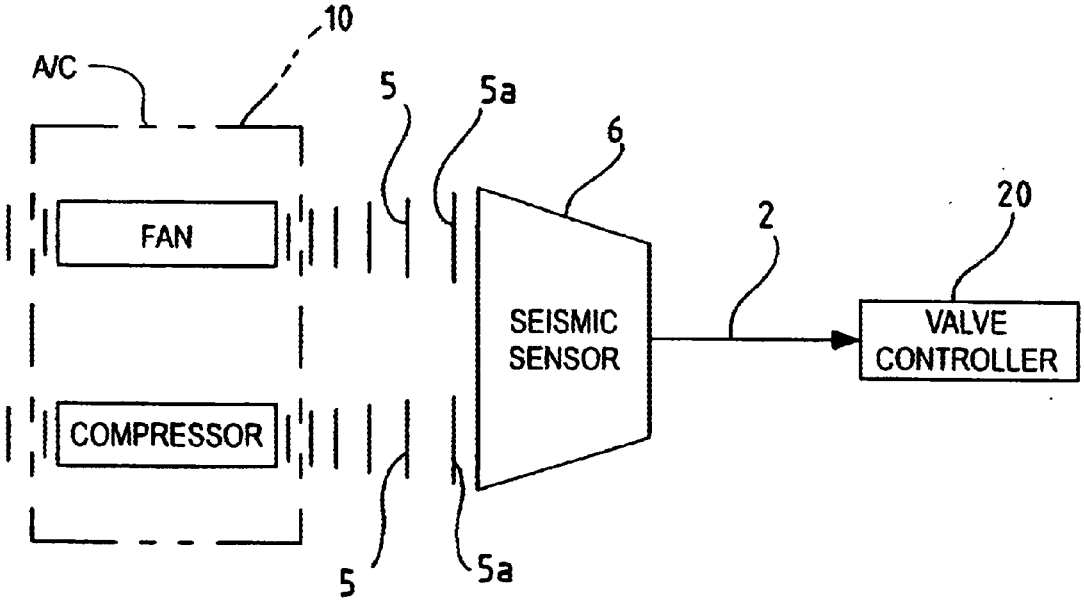
FIG. 6 is a block diagram of the relationship between the fan and/or compressor of the air conditioning unit and a seismic sensor which activates a valve controller.

One preferred embodiment of the auxiliary watering system includes a sensor 6 that detects a seismic pattern 5*a* associated with the operation of the air-conditioning unit 10, as shown in FIG. 6.

To accomplish its function of delivering cooling water along an air path to lower the temperature of the ambient air supply, the auxiliary watering system has a water nozzle 22 with a discharge end 22*a* directed toward the air path. The water nozzle is disposed downstream of the cooling water supply valve 18, so that the discharge end of the water nozzle can release a stream 24 of water into the ambient air supply to reduce the temperature of the ambient air supply and thereby produce increases in efficiency of the air-conditioning unit.

Figure 4:
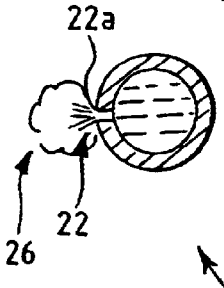
FIG. 4 is a cross sectional view taken along the line of 4—4 of FIG. 3 showing a nozzle hole extending from the header.
Figure 8:
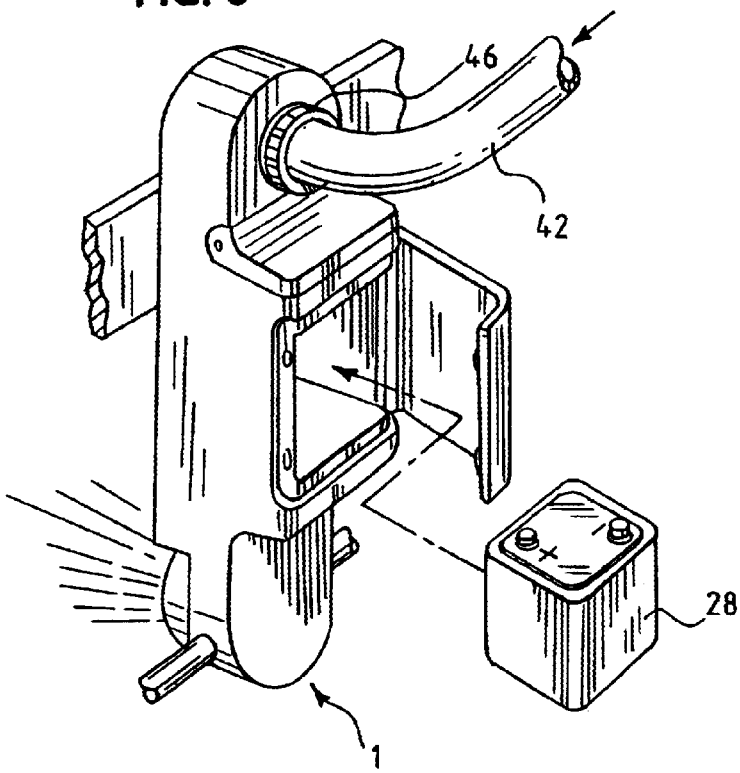
FIG. 8 is an exploded perspective view of a preferred power means for the auxiliary watering system comprising a battery.
Figure 9:
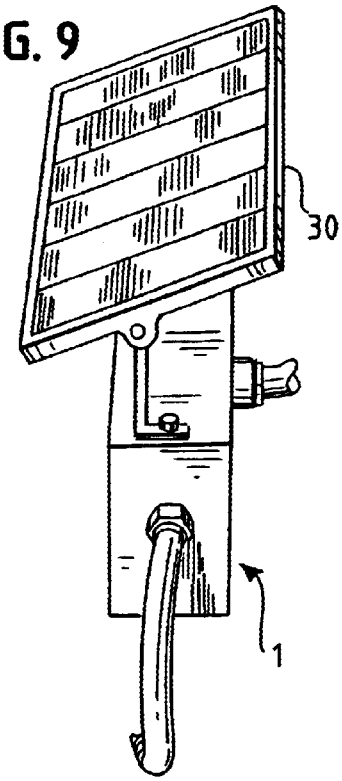
FIG. 9 is a perspective view of a preferred power means for the auxiliary watering system comprising a solar cell.

In one preferred embodiment, as shown in FIG. 4, the discharge end 22*a* of the water nozzle 22 can release the stream of water in the form of a mist 26, and in another preferred embodiment, as shown in FIG. 2, the discharge end 22*a* of the water nozzle 22 can release the stream of water in the form of a spray 24. The sensor 6 and the valve controller 20 of the auxiliary watering system may each be powered by a battery 28, as shown in FIG. 8. This offers portability to the auxiliary watering system. Alternatively, the system can be powered by a solar array 30, as shown in FIG. 9, or an electrical power connection 32 to the air-conditioning unit or to an extraneous source. Said electrical power connection 32 to the air-conditioning unit 10 may be un-switched.

As shown in FIG. 1, the auxiliary watering system may further comprise a support 34 on which the cooling water supply valve 18, the sensor 6, and the valve controller 20 are mounted. The cooling water supply valve 18, the sensor 6, and the valve controller 20 may be integrated in to one unit, i.e. means for delivering cooling water, as shown in the drawing. The support 34 has at least one strap 40 secured thereto, with at least one of a hook 36 and a magnet 38 disposed on a free end 40*a* of the strap 40 for attaching the strap 40 to the air-conditioning unit 10.

Figure 10:
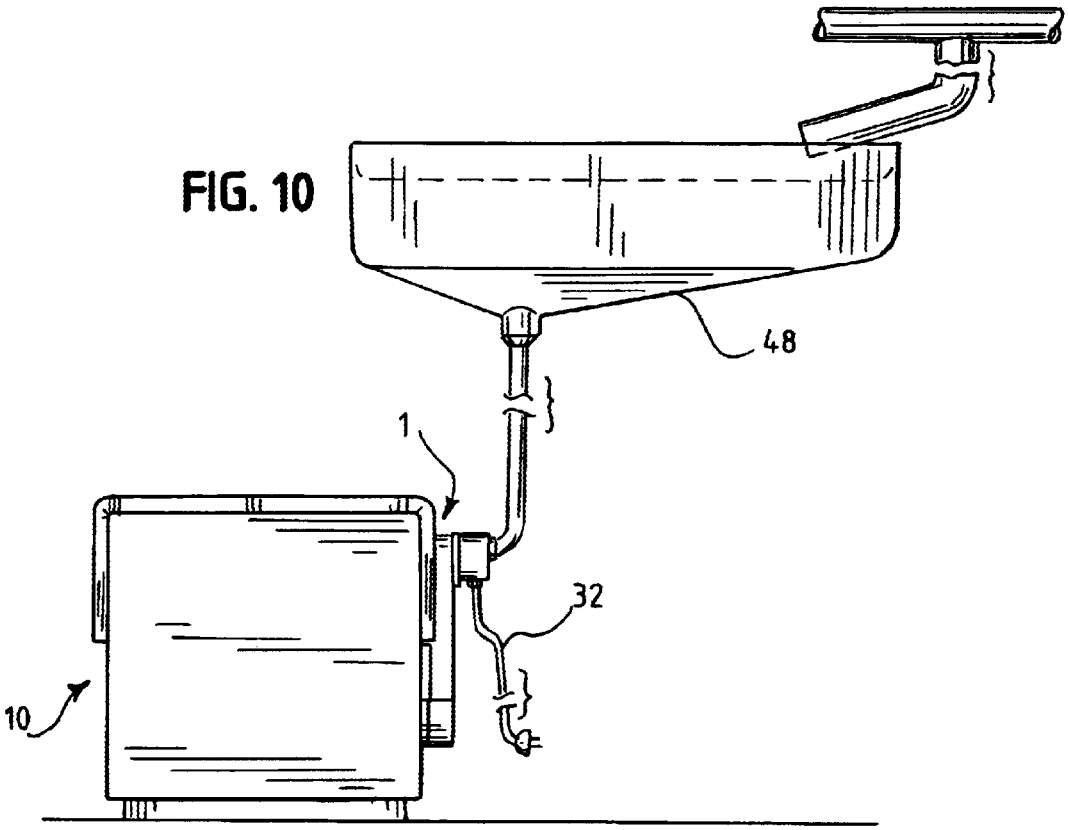
FIG. 10 is a perspective view of the auxiliary watering system showing a reservoir in lieu of a hose for supplying water from a live source.

Water is supplied to the auxiliary watering system in a number of ways. It may comprise a cooling water supply, including having the cooling water supply valve operably connected to a cooling water source, such as a flexible water hose 42 extending from a feed valve 44 and having a means for reversibly connecting 46 to the cooling water supply valve 18 disposed on a free end. A water reservoir 48 could alternatively be provided, as shown in FIG. 10.

In a preferred embodiment of the auxiliary watering system for cooling the ambient air supply which is designed to operate in an environment which includes an air-conditioning unit 10 provided with a condenser 12, condenser coils 14, a fan 16 for moving air over the condenser coils, and an ambient air supply for cooling the air-conditioning unit, the system comprises means for delivering cooling water 1 along an air path to lower the temperature of the ambient air supply that responds to control signals 2 which are independent of a hardwiring control connection from the air-conditioning unit 10. The means for delivering cooling water includes a cooling water supply valve 18 operable between an opened position and a closed position, a sensor 6, which may include a pattern recognition means, a discrimination means, means for filtering, and means for storing an identifying signal, for ascertaining whether the air-conditioning unit is operating and for generating control signals 2, a valve controller 20 that receives the control signals 2, the valve controller being operably connected to the cooling water supply valve 18, and a water nozzle 22 with a discharge end 22*a* directed toward the air path, the water nozzle 22 being disposed downstream of the cooling water supply valve 18.

With this preferred embodiment, the operation of one of the condenser and the fan is sensed by the means for delivering cooling water to control the cooling water being delivered to the ambient air supply, and the cooling water supply valve 18 can be opened by the valve controller upon receiving a control signal 2 from the sensor 6 indicating that the air-conditioning unit is operating, and the discharge end 22*a* of the water nozzle 22 can release a stream of water into the ambient air supply to reduce the temperature of the ambient air supply and thereby produce increases in efficiency of the air-conditioning unit, and the cooling water supply valve can be closed by the valve controller upon receiving a control signal from the sensor that the air-conditioning unit is non-operational.

This important invention includes methods for cooling an ambient air supply which moves along an air path for cooling an air-conditioning unit comprising sensing whether the air-conditioning unit is operating independent of a hard-wiring control connection from the air-conditioning unit, generating a control signal, receiving the control signal to operate a valve controller that opens a cooling water supply valve, and delivering cooling water through the cooling water supply valve to the air path of the ambient air supply to lower the temperature of the ambient air supply.

Figure 5:
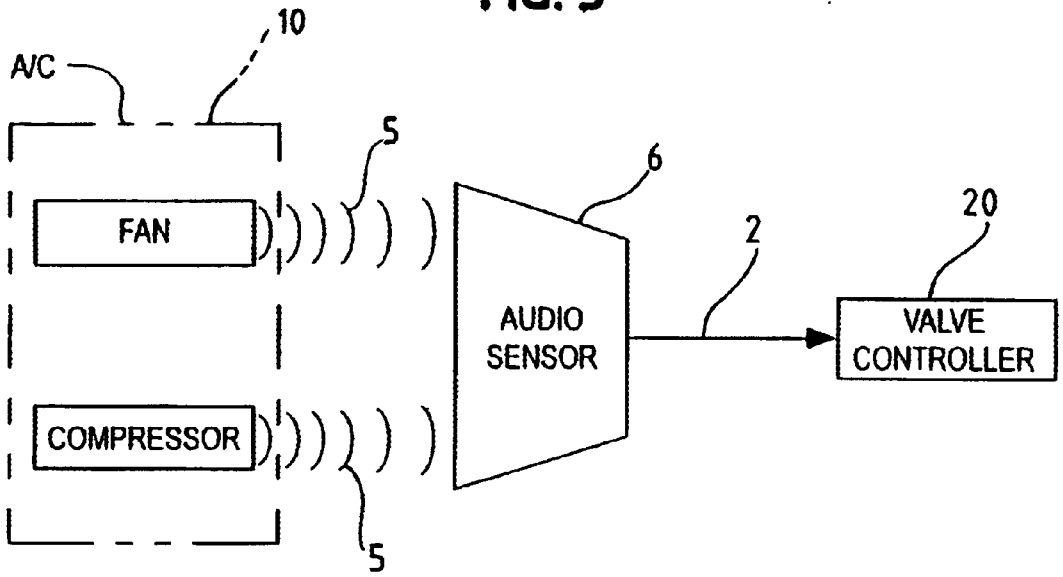
FIG. 5 is a block diagram of the relationship between the fan and/or compressor of the air conditioning unit and an audio sensor which activates a valve controller.

A second method for cooling an ambient air supply which moves along an air path for cooling an air-conditioning unit comprises acousticly sensing whether the air-conditioning unit is operating independent of a hardwiring control connection from the air-conditioning unit, generating a control signal, receiving the control signal to operate a valve controller that opens a cooling water supply valve, and delivering cooling water through the cooling water supply valve to the air path of the ambient air supply to lower the temperature of the ambient air supply, as shown in the block diagram of FIG. 5.

A third method for cooling an ambient air supply which moves along an air path for cooling an air-conditioning unit comprises seismicly sensing whether the air-conditioning unit is operating independent of a hardwiring control connection from the air-conditioning unit, generating a control signal, receiving the control signal to operate a valve controller that opens a cooling water supply valve, and delivering cooling water through the cooling water supply valve to the air path of the ambient air supply to lower the temperature of the ambient air supply, as shown in the block diagram of FIG. 6.

As will be readily appreciated, these methods are readily adapted for means for delivering cooling water which are portable and which can be easily added to an existing air-conditioning unit without the need for tools or a fixtured connection to the air-conditioning unit.

A fourth method for cooling an ambient air supply which moves along an air path for cooling an air-conditioning unit comprises recognizing an acoustic pattern of at least one of the condenser and the fan of the air-conditioning unit, producing code signals with respect to each acoustic pattern from the result of the recognition, the code signals defining traits of the recognized acoustic pattern, the acoustic patterns defining attributes of the air-conditioning unit, and storing in a pattern memory an initial set of code signals associated with an initial set of recognized acoustic patterns, the initial set of code signals defining traits defining initial attributes of the at least one of the condenser and the fan of the air-conditioning unit, repeating the first two steps, comparing the code signals from the pattern recognition means with the initial set of code signals stored in the pattern memory, and producing an identifying signal, the identifying signal defines a corresponding acoustic pattern with code signals that match the initial code signals from the result of the recognition of the initial acoustic pattern of the at least one of the condenser and the fan of the air-conditioning unit, whereby, matching of the corresponding acoustic pattern with the initial acoustic pattern determines that the air-conditioning unit is operating. See FIG. 7.

The 'teach-in' process is initiated after the hose and tubing have been installed and the sensor positioned to detect sound or vibration characteristics of the running air conditioner. While the air conditioner is running, a switch is activated telling the unit to begin sampling the signal generated by the sensor. The system will collect data based on the requirements of the electronics hardware or a software algorithm.

This data collection and frequency analysis process is very similar to methods used in human voice recognition systems. The air conditioner will generate specific frequency patterns which may be unique to this specific air conditioner, but they will be repeatable. The air conditioner will generate it's unique signature when ever it is running. After the signature has been digitally sampled and broken into frequency components the pattern information is saved to a memory device for future retrieval. The 'teach-in' process is now complete.

After 'teach-in' the system will periodically (perhaps every 10 seconds) sample the sensor signal, analyze the frequency spectrum, and compare these new samples with those stored in memory from the time of teach-in. If the current samples match the stored samples, the system recognizes that the air conditioner is running and allows water to flow to the misters. If there is no match to the stored frequency samples, water flow is inhibited. At the next sample interval the sample and compare process is repeated.

Moreover, the method for cooling an ambient air supply may further include filtering the acoustic pattern of one of the condenser and the fan so that only the acoustic pattern of one of the condenser and the fan is recognized.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. In an environment which includes an air-conditioning unit provided with a condenser, condenser coils, a fan for moving air over said condenser coils, and an ambient air supply for cooling the air-conditioning unit, an auxiliary watering system for cooling the ambient air supply comprising means for delivering cooling water along an air path to lower the temperature of the ambient air supply that responds to control signals which are independent of a fixtured connection to the air-conditioning unit or a housing associated with the air-conditioning unit, whereby, operation of one of the condenser and the fan is sensed by the means for delivering cooling water to control cooling water being delivered to the ambient air supply.

2. The auxiliary watering system of claim 1, wherein the means for delivering cooling water comprises:

a. a cooling water supply valve operable between an opened position and a closed position;

b. a sensor for ascertaining whether the air-conditioning unit is operating and for generating control signals; and c. a valve controller that receives the control signals, said valve controller being operably connected to the cooling water supply valve, whereby, the cooling water supply valve is opened by the valve controller upon receiving a control signal from the sensor indicating that said air-conditioning unit is operating and the cooling water supply valve is closed by the valve controller upon receiving a control signal from the sensor that said air-conditioning unit is non-operational.

3. The auxiliary watering system of claim 2, wherein the sensor detects an acoustic pattern associated with the operation of the air-conditioning unit.

4. The auxiliary watering system of claim 3, wherein the sensor is disposed at a spaced distance from said air-conditioning unit.

5. The auxiliary watering system of claim 2, wherein the means for delivering cooling water further comprises a water nozzle with a discharge end directed toward the air path, said water nozzle being disposed downstream of the cooling water supply valve, whereby, the discharge end of the water nozzle can release a stream of water into the ambient air supply to reduce the temperature of the ambient air supply and thereby produce increases in efficiency of the air-conditioning unit.

6. The auxiliary watering system of claim 5, wherein the discharge end of the water nozzle can release the stream of water in the form of a mist.

7. The auxiliary watering system of claim 5, wherein the discharge end of the water nozzle can release the stream of water in the form of a spray.

8. The auxiliary watering system of claim 2, wherein the sensor and the valve controller are each powered by a battery.

9. The auxiliary watering system of claim 2, wherein the sensor and the valve controller are each powered by a solar array.

10. The auxiliary watering system of claim 2, wherein the cooling water supply valve is operably connected to a cooling water source.

11. The auxiliary watering system for cooling an ambient air supply of claim 1, wherein the means for delivering cooling water further comprises a cooling water supply.

12. The auxiliary watering system for cooling an ambient air supply of claim 11, wherein the cooling water source comprises a flexible water hose extending from a feed valve and having a means for reversibly connecting to the cooling water supply valve disposed on a free end.

13. In an environment which includes an air-conditioning unit provided with a condenser, condenser coils, a fan for moving air over said condenser coils, and an ambient air supply for cooling the air-conditioning unit, an auxiliary watering system for cooling the ambient air supply comprising means for delivering cooling water along an air path to lower the temperature of the ambient air supply that responds to control signals which are independent of a hardwiring control connection to the air-conditioning unit, wherein the means for delivering cooling water further comprises:

a. a pattern recognition means for recognizing an acoustic pattern of at least one of the condenser and the fan of the air-conditioning unit, and for producing code signals with respect to each acoustic pattern from the result of said recognition, said code signals defining traits of the recognized acoustic pattern, said acoustic patterns defining attributes of the air-conditioning unit; and b. a discrimination means having a pattern memory in which an initial set of code signals associated with an initial set of recognized acoustic patterns is stored, said initial set of code signals defining initial attributes of the at least one of the condenser and the fan of the air-conditioning unit, for comparing the code signals from the pattern recognition means with the initial set of code signals stored in the pattern memory, and for producing an identifying signal, said identifying signal defines a corresponding acoustic pattern with code signals that match the initial code signals from the result of the recognition of the initial acoustic pattern of the at least one of the condenser and the fan of the air-conditioning unit, whereby, operation of one of the condenser and the fan is sensed by the means for delivering cooling water to control cooling water being delivered to the ambient air supply, and matching of the corresponding acoustic pattern with the initial acoustic pattern determines that the air-conditioning unit is operating.

14. The auxiliary watering system of claim 13, wherein the pattern recognition means includes means for filtering the acoustic pattern of one of the condenser and the fan.

15. In an environment which includes an air-conditioning unit provided with a condenser, condenser coils, a fan for moving air over said condenser coils, and an ambient air supply for cooling the air-conditioning unit, an auxiliary watering system for cooling the ambient air supply comprising means for delivering cooling water along an air path to lower the temperature of the ambient air supply that responds to control signals which are independent of a hardwiring control connection to the air-conditioning unit, wherein the means for delivering cooling water comprises:

d. a cooling water supply valve operable between an opened position and a closed position;

e. a sensor for ascertaining whether the air-conditioning unit is operating and for generating control signals; and f a valve controller that receives the control signals, said valve controller being operably connected to the cooling water supply valve, whereby, operation of one of the condenser and the fan is sensed by the means for delivering cooling water to control cooling water being delivered to the ambient air supply, and the cooling water supply valve is opened by the valve controller upon receiving a control signal from the sensor indicating that said air-conditioning unit is operating and the cooling water supply valve is closed by the valve controller upon receiving a control signal from the sensor that said air-conditioning unit is non-operational, further comprising a support on which the cooling water supply valve, the sensor, and the valve controller are mounted, said support having at least one strap secured thereto, with at least one of a hook and a magnet disposed on a free end of said strap for attaching said strap to the air-conditioning unit.

16. In an environment which includes an air-conditioning unit provided with a condenser, condenser coils, a fan for moving air over said condenser coils, and an ambient air supply for cooling the air-conditioning unit, an auxiliary watering system for cooling the ambient air supply comprising means for delivering cooling water along an air path to lower the temperature of the ambient air supply that responds to control signals which are independent of a direct connection from the air-conditioning unit, said means for delivering cooling water comprising:

a. a cooling water supply valve operable between an opened position and a closed position;

b. a sensor, including its housing, disposed at a spaced distance from the air-conditioning unit for ascertaining whether the air-conditioning unit is operating and for generating control signals;

c. a valve controller that receives the control signals, said valve controller being operably connected to the cooling water supply valve; and d. a water nozzle with a discharge end directed toward the air path, said water nozzle being disposed downstream of the cooling water supply valve, whereby, operation of one of the condenser and the fan is sensed by the means for delivering cooling water to control the cooling water being delivered to the ambient air supply, and the cooling water supply valve can be opened by the valve controller upon receiving a control signal from the sensor indicating that said air-conditioning unit is operating, whereby, the discharge end of the water nozzle can release a stream of water into the ambient air supply to reduce the temperature of the ambient air supply and thereby produce increases in efficiency of the air-conditioning unit, and the cooling water supply valve can be closed by the valve controller upon receiving a control signal from the sensor that said air-conditioning unit is non-operational.

17. A method for cooling an ambient air supply which moves along an air path for cooling an air-conditioning unit, comprising:

a. acoustically sensing whether the air-conditioning unit is operating independent of a fixtured connection to the air-conditioning unit or a housing associated with the air-conditioning unit;

b. generating a control signal;

c. receiving the control signal to operate a valve controller that opens a cooling water supply valve; and d. delivering cooling water through the cooling water supply valve to the air path of the ambient air supply to lower the temperature of the ambient air supply.

18. A method for cooling an ambient air supply which moves along an air path for cooling an air-conditioning unit, comprising:

a. recognizing an acoustic pattern of at least one of the condenser and the fan of the air-conditioning unit;

b. producing code signals with respect to each acoustic pattern from the result of said recognition, said code signals defining traits of the recognized acoustic pattern, said acoustic patterns defining attributes of the air-conditioning unit; and c. storing in a pattern memory an initial set of code signals associated with an initial set of recognized acoustic patterns, said initial set of code signals defining traits defining initial attributes of the at least one of the condenser and the fan of the air-conditioning unit;

d. repeating steps a and b;

e. comparing the code signals from the pattern recognition means with the initial set of code signals stored in the pattern memory; and f. producing an identifying signal, said identifying signal defines a corresponding acoustic pattern with code signals that match the initial code signals from the result of the recognition of the initial acoustic pattern of the at least one of the condenser and the fan of the air-conditioning unit, whereby, matching of the corresponding acoustic pattern with the initial acoustic pattern determines that the air-conditioning unit is operating.

19. The method for cooling an ambient air supply of claim 18, which further includes filtering the acoustic pattern of one of the condenser and the fan so that only the acoustic pattern of one of the condenser and the fan is recognized.

* * * * *